US005476265A

United States Patent [19]

Miller et al.

[11] Patent Number: 5,476,265

[45] Date of Patent: Dec. 19, 1995

[54] GAME OF CHANCE

[75] Inventors: Gregory L. Miller, Rolling Hills; Ron Sarakbi, Huntington Beach, both of Calif.

[73] Assignee: Normandie Casino, Gardena, Calif.

[21] Appl. No.: 423,079

[22] Filed: Apr. 17, 1995

[51] Int. Cl.[6] ..... A63F 1/00

[52] U.S. Cl. ..... 273/292; 273/306

[58] Field of Search ..... 273/292, 309, 273/274, 306

[56] References Cited

U.S. PATENT DOCUMENTS

| | | | |
|---|---|---|---|
| 5,013,049 | 5/1991 | Tomaszewski | 273/292 |
| 5,275,415 | 1/1994 | Wisted | 273/292 |
| 5,366,228 | 11/1994 | Kangsanaraks | 273/292 |
| 5,368,305 | 11/1994 | Rodda et al. | 273/292 |
| 5,407,208 | 4/1995 | Keller et al. | 273/274 |

*Primary Examiner*—Benjamin H. Layno
*Attorney, Agent, or Firm*—Bruce A. Jagger

[57] ABSTRACT

In a game, performable in a gaming house, the winner, as between a banker player and the other players, is determined by assigning a value of one or eleven points to aces or special pieces, between zero and one point to face pieces, and face value to numeric pieces. A nominal value between 7 and eleven and one half is established. If the value of the banker player's hand is less than the nominal value and the value of another player's hand is greater than the banker player's hand but less than or equal to the nominal value, the other player is declared the winner. If the value of the banker player's hand is more than the nominal value and the value of the other player's hand is less than the value of said banker player's hand, the other player is declared the winner. The holder of a single special piece is declared the winner as against all other combinations. The banker player is declared the winner under all other conditions.

15 Claims, 1 Drawing Sheet

GAME OF CHANCE

BACKGROUND OF THE INVENTION

1. Field of the Invention

The present invention relates to a game of chance and, in particular, to such a game which utilizes playing pieces to which different values may be assigned in a wagering environment.

2. Description of Related Art and Other Considerations

Various wagering games of chance have been proposed wherein the players play against the "house" or another player who is acting as a "banker". Various games of chance had previously been devised wherein different values were assigned to the playing pieces. Attention is invited to Richard L. Frey, rev., "The New Complete Hoyle Revised" (New York: Doubleday, 1991), 3–14, 513–527, 541–548, for a detailed description of various recognized wagering games. The problem of devising a simple, easily played, fast moving game wherein the combined elements of play are presented in such a way as to maintain a high degree of interest and enjoyment on the part of the players had generally eluded previous workers in this art. Those concerned with these problems recognize the need for an improved game. These and other problems are successfully addressed and overcome by the present invention.

SUMMARY OF THE INVENTION

The playing pieces according to the present invention comprise, for example, cards, tiles or any equivalent media which have a display thereon of numbers, letters, designs and the like that are capable of establishing an order of prevalence for enabling play of the game. The order of prevalence may comprise a single one or a combination of playing pieces whose total or aggregate enables a set of one or more playing pieces to prevail over another set of one or more of the playing pieces. Most commonly, for example, the display utilizes numbers respectively valued from 2–10, special pieces or Aces valued at 1 or 11, and pieces with face depictions thereon (e.g., King, Queen and Jack) valued at 1, ½ or 0, depending on what the optimum desired value has been set at. Wild cards, such as Jokers, if desired, may be used as are conventional in such games.

The playing pieces comprise, for example, a standard 52 card deck or a set of tiles which are capable of establishing, singly and in combination, an order of prevalence that enables a selection of one or more of the playing pieces to prevail over another selection of one or more of the playing pieces. Preferably, the 4 Aces are withdrawn from the deck and replaced with 4 special cards, designated, for example, as "E 0 11" cards. The E 0 11 cards are assigned the optimum value for the game so that the holder of a single E 0 11 card is the winner as against all other cards and combinations of cards.

There may be as many participants as desired; however, a minimum of two players, preferably in addition to the dealer, is required. The two players are selected, preferably by some random selection method, to function in the roles of an action player and a banker player. Preferably a third participant, often an employee or member of the gaming house, is responsible for administering the play of the game, including dealing the playing pieces, exposing the playing pieces, and distributing the winnings. Preferably, the third participant does not act as the banker or as any other player. The third participant however, act as the banker or as any other player, if this is desired.

Wagers are preferably placed before play commences. After a round of playing pieces is dealt to the players by the dealer, preferably face down the players inspect their respective pieces in confidence and determine whether additional playing pieces are desired. Additional playing pieces are dealt to the players as they may desire. Preferably, all of the additional playing pieces desired by a player are dealt at one time before going to the next player. Alternatively, additional desired playing pieces may be dealt to each player in turn. According to the preferred mode of play, when all of the players except the banker player have received all of the playing pieces they desire, the banker player's first playing piece is exposed and the dealer furnishes the banker player with as many additional playing pieces as the banker player may desire.

The first player to play against the banker player is conveniently described as the action player. The action player is generally selected from the group of players, except the banker player, by means of some random selection procedure, such as casting dice, or the like. When play between the banker player and the first action player is concluded, play passes to a second player who then becomes the action player. Play thus proceeds from player to player in a predetermined rotation.

Preferably, values are assigned to the playing pieces as follows: Aces (if present) are assigned a value of 1 or 11, face pieces are assigned a value of 1 and numeric pieces are assigned their indicated values. In general, a desired optimum value is assigned as the objective or goal of the game. E 0 11 pieces, if present, are assigned a value which is equal to the optimum value for the game. If the optimum value is, for example, 11, the E 0 11 piece has a value of 11. This is conveniently described as a "natural 11" and wins over any other combination of pieces which may total to 11. The E 0 11 piece may, at its holder's option, be assigned a value of 1.

The object of the play is generally to receive a set of playing pieces, the aggregate of which equals the desired optimum value. Preferably, the rules of play favor the player who receives playing pieces which aggregate less than the desired optimum value as against a player who receives more than the optimum value. Preferably, a first player who goes over the optimum loses, as against a second player who has anything less than the optimum value, but may win as against a third player who has exceeded the optimum by more than the first player. Alternatively, the rules may provide that any player who goes over the optimal value will automatically lose as against all other players. Preferably, the optimum value is 11 with optimum values of from 7 to 10 or even 11 ½ or 12 being possible, but less preferable.

According to the preferred embodiment wherein the Aces are removed from the deck and different non-conventional pieces are substituted for them, such different cards preferably bear some unique depiction, for example, "E 0 11" and a graphic of a pair of dice.

Several advantages are derived from this invention, particularly when the optimum value is 11 and special playing pieces, for example, E 0 11 pieces, are used. For example, this is a very fast moving game which maintains the players' interest. There are fewer playing pieces involved than with most games. The possibility of acquiring one of the special pieces, with its superior value, keeps interest high. The gaming house is preferably not an active player so as to afford equal odds to all players within the rules of a particular game. The gaming house generally is compensated by either a percentage of the pot or a flat fee per hand.

Other aims and advantages, as well as a more complete understanding of the present invention and its novel features, will appear from the following explanation of exemplary embodiments and the accompanying drawings thereof.

DETAILED DESCRIPTION OF THE PREFERRED EMBODIMENTS

Figure 1:
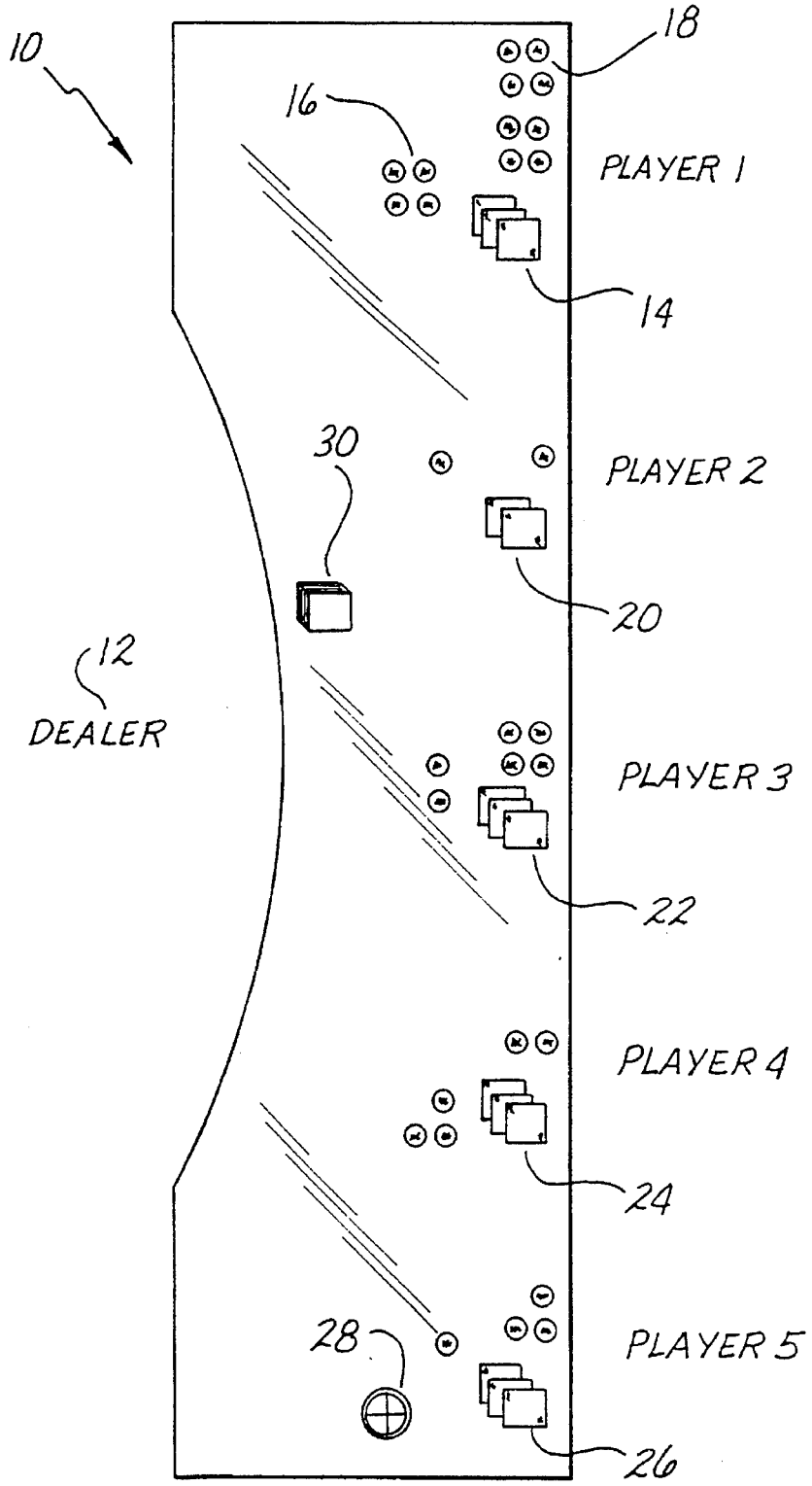
FIG. 1 is a view of a typical set up for playing the game of the present invention with play in progress.

Referring particularly to the drawing for purposes of illustration and not limitation, the overall physical paraphernalia or equipment and articles used in the present invention are indicated generally at 10. Disposed in various locations on the surface of a gaming table are various playing pieces, wagers and an action button. As will be understood by those skilled in the art, alternative, supplemental or additional paraphernalia, equipment and articles may be utilized within the scope of the invention.

The participants include players whose positions are designated in FIG. 1. For purposes of illustrating the present invention, five players are shown; however, if more or fewer players were present, they could be accommodated. The dealer 12 is, for example, an employee of the gaming house, and the players are visitors or invites thereto to play the game.

The gaming table is shown as it would appear part way through a typical round of play. The dealer 12 has dealt to Player 1, from a deck of playing pieces 30, a hand 14 consisting of, for example, pieces with numeric values of 5, 2 and 3. Player 1 has placed a wager 16 which consists of 4 chips. Player 1 has in reserve, but has not wagered on this round of play, 8 chips 18. Player 2 has received a hand 20 which consists, for example, of a Jack and an E 0 11, and has placed a wager of one chip with one chip in reserve. Player 3 has received from the dealer 12 a hand 22 consisting, for example, of a piece with a numeric value of 2 and a King and an E 0 11. Player 3 has placed a wager of 2 chips and has 4 chips in reserve. Player 4 has received a hand 24 which consists, for example, of a 5 and 8 and an E 0 11, and has placed a wager of 3 chips with 2 chips in reserve. Player 5's hand 26 consists, for example, of a 3, a 7 and a Queen, and has placed a wager of 1 chip with 3 chips in reserve. No player has just an E 0 11 playing piece so no player is a natural winner. Each holder of an E 0 11 piece will likely assign a value of 1 to the E 0 11 piece. Each holder of an E 0 11 piece received it as a second or later draw because the player would not have requested another piece if the E 0 11 piece had been his first draw.

The action button 28 is before Player 5. This indicates two things. Player 5 is not the Banker player and Player 5 will be the first to play against the Banker. When Player 5 is finished playing against the Banker, the action will rotate, for example, clockwise to Player 1, if Player 1 is not the Banker player, or to Player 2 is Player 1 is the Banker player. Selection of the Action player and the Banker player is accomplished by some suitable random selection means. Once play is commenced the positions of Action player and Banker player rotate between rounds by some predetermined order to all of the Players in turn. The Dealer is preferably not a player and is, therefore, not included in the rotation.

For the sake of this example only, the values of the playing pieces are assumed to be, special pieces, 1 or 11, at the players option, face pieces 1, numeric cards at face value, and no jokers. Assuming that the respective hands 14, 20, 22, 24 and 26 valued as described above, and the objective being, for the sake of example only, to reach 11, with Player 1 acting as the Banker player; Player 5, with 3, 7 and a Queen in hand 26, for a total of 11, would win as against the Banker, with 5, 2 and 3 in hand 14, for a total of 10. This would leave the Banker with 3 chips in his wager 16. Play would rotate clockwise to Player 2 who would lose with a Jack and an E 0 11 piece in hand 20, for a total of 2 or 12, as against the Banker, leaving the Banker with 4 chips in his wager 16. Play would next rotate to Player 3 with 2, King and E 0 11 in hand 22, for a total of 4 or 14. Assume Player 3 assigns a value of 11 to the E 0 11 piece. Player 3 is over the nominal goal of 11, and the Banker is under, so the Banker would win, leaving the Banker with 6 chips in his wager 16. Lastly Player 4 with 5, 8 and an E 0 11 piece, for a total of 14 would lose to the Banker, leaving the Banker with 9 chips in his wager 16. Play for this round would then terminate and the action button 28 would preferably move to a new player. The Banker player would preferably remain in that capacity for a predetermined number of rounds of play, for example, three or four rounds. Usually, but not necessarily, the Action player button 28 moves in turn to the next player after each round. Player 5, with the optimum value of 11, would prevail unless the banker also held a value of 11. Under the preferred rules if the Banker player and Player 5 both held values of 11 the outcome would be declared a draw unless one player had a natural 11 by way of a single E 0 11 piece. Alternatively, In the event of a tie the Banker Player wins.

Preferably play is completed with the first Action player before the playing pieces of the second Action player in turn are exposed. The Banker's playing pieces are exposed at least when play starts against the first Action player, and preferably, when the Banker requests additional playing pieces, if any, from the dealer 12.

Preferably, all wagers are placed by all players before the playing pieces, for example, the cards or tiles, are dealt. Preferably, the banker also selects from his reserve an amount of money or chips which he is willing to risk losing, and places this amount before him as his wager, before the playing pieces are dealt. The banker player's loses are limited to this amount.

The sets of playing pieces may be dealt one at a time in rotation so that each player receives one piece before any player receives a second piece. The action player is then allowed to request as many pieces as desired before the next player has the opportunity to request playing pieces. Alternatively, all of the pieces in one player's set may be dealt to him before any pieces are dealt to the next player, or the pieces may be dealt in rotation. Other variations may be used if desired.

Each player, but preferably not the banker, looks at his playing pieces and decides whether to request additional pieces.

Preferably, after all of the players, except the banker, have received all of the playing pieces that they request, the dealer then turns over the banker's playing piece. The banker then determines whether to request additional pieces, and the dealer provides the Banker with as many pieces as requested.

The house dealer then turns to the player with the action button before him, in this example Player 5, and turns over the playing pieces in that player's hand 26. This shows a win, lose or draw vis-a-vis the banker's playing pieces in his hand 14.

If the Action player wins, the Banker gives an amount of money or chips from the total before him to satisfy the extent of the wager of that Action player. If the amount before the banker is insufficient to satisfy the Action player's winnings, then the Banker gives all he has to the Action player and this round of play is concluded. Preferably, no additional amount is owed by the Banker beyond what he placed on the table at the start of play. If the Banker has no more funds on the table before him, that round of play terminates, and the remaining players lose their right to play in that round. The remaining players keep their wagers. If money or chips are left before the banker after the action player is satisfied, play then proceeds to the next player.

As will be understood by those skilled in the art, many modifications and variations of the present invention are possible in light of the above teachings. It is therefore to be understood that, within the scope of the appended claims, the invention may be practiced otherwise than as described. Various alternative, supplemental or additional steps and operations may be utilized within the scope of the invention.

What is claimed is:

1. A method of playing a game of skill and chance the object of which is for a player to acquire one or more playing cards whose aggregate totals a nominal value of between eleven and eleven and one half or a value more than said nominal value but less than the aggregate of one or more playing cards held by a banker player, requiring a minimum of two persons, comprising the steps of:

utilizing playing cards which are capable of establishing an order of prevalence singly and in combination whose aggregate enables a hand of one or more of the playing cards to prevail over another hand of one or more of the playing cards;

selecting one of the persons as dealer of the playing cards, one of the persons as an action player, and one of the persons as a banker;

placing wagers respectively by the players, including the banker, the banker placing wager Step being limited by the banker to a maximum amount of wager which he is willing to risk;

the dealer furnishing only one randomly selected first playing card face down to each of the players in turn whose responsibility is to examine only the value of said first playing card to determine whether additional playing cards are desired;

after each player is provided with a first playing card, the dealer furnishing as many additional playing cards as requested to the action player to form an action player's hand;

after said action player has been furnished as many playing cards as requested, the dealer furnishing as many additional playing cards as requested to each subsequent player, one player at a time, so as to form a hand for each additional player except the banker;

after all other players have been furnished as many playing cards as requested, exposing the banker player's first playing card, and the dealer furnishing as many additional playing cards as requested to the banker player, to form a banker player's hand;

exposing all hidden playing cards of the action player;

determining the value of the banker player's hand, determining the value of the action player's hand, and comparing the values of the respective hands to determine an order of prevalence between the action player and the banker player, thereby to determine the winner;

in determining said order of prevalence assigning a value of one or eleven points to special cards or aces, one half point to face cards, and face value to numeric cards, if the value of the banker player's hand is less than said nominal value and the value of the action player's hand is greater than the banker player's hand but less than or equal to said nominal value, declaring the action player the winner, if the value of the banker player's hand is more than said nominal value and the value of the action player's hand is less than the value of said banker player's hand, declaring the action player the winner, and declaring the banker player the winner under all other conditions;

in the event that the banker player's hand prevails against the action player's hand, giving the amount of the action player's wager to the banker player, at which time, play passes to a subsequent player who becomes the action player;

in the event that the action player's hand prevails against the banker's hand, giving an amount, equal to the amount of the action player's wager but not exceeding the maximum amount of the banker player's wager, from the banker player's wager to the action player, at which time, play passes to a subsequent player who becomes the action player, provided the maximum amount of the banker player's wager has not been reached; and the dealer terminating play when all of the players have played to the determination of an outcome or the banker player's wager entire wager and winnings have been distributed to other players.

2. A method of playing a game of skill and chance according to claim 1 including at least 3 persons, selecting a first person as the action player, a second person as the banker player and a third person as the dealer.

3. A method of playing a game of skill and chance the object of which is for a player to acquire one or more playing pieces whose aggregate totals a nominal value of between seven and eleven or a value more than said nominal value but less than the aggregate of one or more playing pieces held by a banker player, requiring a minimum of two persons, comprising the steps of:

utilizing playing pieces including special pieces, face and numeric pieces which are capable of establishing an order of prevalence singly and in combination whose aggregate enables a hand of one or more of the playing pieces to prevail over another hand of one or more of the playing pieces;

selecting one of the persons as dealer of the playing pieces, one of the persons as an action player, and one of the persons as a banker;

placing wagers respectively by the players;

the dealer furnishing only one randomly selected first playing piece face down to each of the players in turn whose responsibility is to examine only the value of said first playing piece to determine whether additional playing pieces are desired;

after each player is provided with a first playing piece, the dealer furnishing as many additional playing pieces as requested to the action player to form an action players hand;

after said action player has been furnished as many playing pieces as requested, the dealer furnishing as many additional playing pieces as requested to each subsequent player, one player at a time, so as to form a hand for each additional player except the banker;

after all other players have been furnished as many playing pieces as requested, exposing the banker player's first playing piece, and the dealer furnishing as many additional playing pieces as requested to the banker player, to form a banker player's hand;

exposing all hidden playing pieces of the action player;

determining the value of the banker player's hand, determining the value of the action player's hand, and comparing the values of the respective hands to determine an order of prevalence between the action player and the banker player, thereby to determine the winner;

in determining said order of prevalence assigning a value of one or eleven points to special pieces, between zero and one point to face pieces, and face value to numeric pieces, said special pieces being designated as having a natural 11 value, if the value of the banker player's hand is less than said nominal value and the value of the action player's hand is greater than the banker player's hand but less than or equal to said nominal value, declaring the action player the winner, if the value of the banker player's hand is more than said nominal value and the value of the action player's hand is less than the value of said banker player's hand, declaring the action player the winner, declaring the holder of a single special piece the winner, and declaring the banker player the winner under all other conditions;

distributing the respective wagers based on the determination of which player is declared to be the winner, at which time play passes to a subsequent player who becomes the action player; and the dealer terminating play when the players have played to the determination of an outcome.

4. A method of claim 3 including selecting a dealer who is not a player.

5. A method of claim 3 including assigning a value of one half point to face pieces.

6. A method of claim 3 including assigning a value of zero to face pieces.

7. A method of claim 3 including assigning a value of 1 to face pieces.

8. A method of claim 3 including assigning a value of 11 to special pieces.

9. A method of claim 3 including assigning a value of 1 to special pieces.

10. A method of claim 3 including permitting the banker player to limit his wager to the amount he is willing to risk before play commences, and the dealer terminating play when all of the players have played to the determination of an outcome or the banker player's wager and winnings have been exhausted.

11. A method of playing a game of skill and chance the object of which is for a player to acquire one or more playing pieces whose aggregate totals a nominal value of between seven and twelve or a value more than said nominal value but less than the aggregate of one or more playing pieces held by a banker player, requiring a minimum of two persons, comprising the steps of:

utilizing playing pieces including ace, face and numeric pieces which are capable of establishing an order of prevalence singly and in combination whose aggregate enables a hand of one or more of the playing pieces to prevail over another hand of one or more of the playing pieces;

selecting one of the persons as dealer of the playing pieces, one of the persons as an action player, and one of the persons as a banker;

placing wagers respectively by the players;

the dealer furnishing only one randomly selected first playing piece face down to each of the players in turn whose responsibility is to examine only the value of said first playing piece to determine whether additional playing pieces are desired;

after each player is provided with a first playing piece, the dealer furnishing as many additional playing pieces as requested beginning with the action player to form hands for each player;

exposing the banker player's hand;

exposing the action player's hand;

determining the value of the banker player's hand, determining the value of the action player's hand, and comparing the values of the respective hands to determine an order of prevalence between the action player and the banker player, thereby to determine the winner;

in determining said order of prevalence assigning a value of one or eleven points to aces, between zero and one point to face pieces, and face value to numeric pieces, if the value of the banker player's hand is less than said nominal value and the value of the action player's hand is greater than the banker player's hand but less than or equal to said nominal value, declaring the action player the winner, if the value of the banker player's hand is more than said nominal value and the value of the action player's hand is less than the value of said banker player's hand, declaring the action player the winner, and declaring the banker player the winner under all other conditions;

distributing the respective wagers based on the determination of which player is declared to be the winner, at which time play passes to a subsequent player who becomes the action player; and the dealer terminating play when the players have played to the determination of an outcome.

12. A method of claim 11 including permitting the banker player to limit his wager to the amount he is willing to risk before play commences, and the dealer terminating play when all of the players have played to the determination of an outcome or the banker player's wager and winnings have been exhausted.

13. A method of claim 11 including providing each player with no more than one playing piece in turn.

14. A method of claim 11 including providing each player with all of the playing pieces desired before moving to the next player.

15. A method of claim 11 wherein the banker player is the dealer.

* * * * *